US006857956B2

(12) United States Patent
Fuchs

(10) Patent No.: US 6,857,956 B2
(45) Date of Patent: Feb. 22, 2005

(54) AIRLOCK SYSTEM AND METHOD FOR PROTECTING A TOXIC-FREE AREA

(75) Inventor: Karl-Hans Fuchs, Zikhron Yaaqov (IL)

(73) Assignee: Filt Air Ltd., Zikhron Yaaqov (IL)

( * ) Notice: Subject to any disclaimer, the term of this patent is extended or adjusted under 35 U.S.C. 154(b) by 0 days.

(21) Appl. No.: 10/648,230

(22) Filed: Aug. 27, 2003

(65) Prior Publication Data

US 2004/0166795 A1 Aug. 26, 2004

(30) Foreign Application Priority Data

Feb. 24, 2003 (IL) ..... 154597

(51) Int. Cl.[7] ..... E06B 7/02
(52) U.S. Cl. ..... 454/195; 49/41
(58) Field of Search ..... 454/187, 188, 454/189, 195, 255; 49/41

(56) References Cited

U.S. PATENT DOCUMENTS 3,285,209 A * 11/1966 Pace ..... 109/8
3,828,490 A * 8/1974 Duquette ..... 52/2.14
4,385,469 A * 5/1983 Scheuerpflug et al. ..... 49/41
4,581,986 A * 4/1986 Conklin et al. ..... 454/187
4,586,441 A * 5/1986 Zekich ..... 109/8
4,604,111 A * 8/1986 Natale ..... 95/284
4,850,264 A * 7/1989 Kiser ..... 454/255
5,042,367 A * 8/1991 Hopkins ..... 454/195
5,042,997 A * 8/1991 Rhodes ..... 96/18
5,746,652 A * 5/1998 Lee et al. ..... 454/187

* cited by examiner

*Primary Examiner*—Derek S. Boles
(74) *Attorney, Agent, or Firm*—Jacobson Holman PLLC

(57) ABSTRACT

There is provided an airlock system utilizable with a protected Toxic Free Area (TFA) defined by an enclosure including spaced-apart first and second door arrangements, each door arrangement having an entrance and an exit and being divided by partitions into a plurality of sections, an airlock space coupled to, and bridging between, the first and second door arrangement, the exit of the second door being connectable to the protected TFA, while the first door arrangement having its entrance located outside the TFA, the arrangement being such that there is no direct airflow from the entrance of the first door arrangement to the exit of the second door arrangement. A method for facilitating entrance and egress from a Toxic Free Area (TFA) defined by an enclosure, without the danger of contamination of the protected TFA, is also provided.

21 Claims, 4 Drawing Sheets

AIRLOCK SYSTEM AND METHOD FOR PROTECTING A TOXIC-FREE AREA

FIELD OF THE INVENTION

The present invention relates to an airlock system and method for protecting a Toxic Free Area (TFA), defined by wall surfaces, from hazardous materials to be transported in by the persons entering the protected area. More particularly, the invention is concerned with an airlock system and method to be used with a structure having a TFA, for preventing the penetration of contaminated air and/or gases, liquids or aerosols therethrough due to traffic entering and exiting the airlock.

BACKGROUND OF THE INVENTION

There is an increasing need for protection against the penetration of contaminants into a sheltered space, given the threat of military attacks and acts of terror using nuclear, chemical or biological (NBC) means of warfare. Such protection is provided by the use of shelters and protected spaces located inside buildings. Shelters are provided with professional NBC air filtration systems including blowers, which create an overpressure inside the protected space and provide cleaned and filtered air. The overpressure is required in order to ensure an unequivocal direction of airflow from inside the protected space to the outside atmosphere, through ever-present leaks in the walls of the shelter, the door and the window seals. Use of this method assures that no contaminated air will penetrate into the protected space. Due to the potential of terror attacks shelters alone can no longer provide the degree of protection to be used as protected space, but complete facilities or parts of buildings have to be pressurized using airtight windows and other required elements. Pressurized buildings are also required for special applications such as isolation purposes.

In view of the unfortunate improvements in warfare and warfare agents, the need for more efficient airlocks which can reduce the minimum time of stay within the airlock, becomes an important requirement. Especially in the case of "silent terror attacks", where no alert is given and the threat is not obvious to the population and even the experts, complete buildings have to be protected and used all times under conditions such as in a terror attack. For such applications airlocks of the kind commonly used in shelters are not applicable. In such airlocks both doors could not be open at the same time—either the exit or the entrance door has to be closed during times when the other door is opened. Due to the fact that thousands of persons pass through such airlocks each day in stores, in office buildings, etc., the system of airlocks and the like have to be modified, in order to provide a new level of public safety.

DISCLOSURE OF THE INVENTION

It is therefore a broad object of the present invention to overcome the disadvantages of the commonly used airlocks and to provide a system and method utilizable for airlocks as entrances to buildings or parts of buildings that are under overpressure relative to the atmospheric pressure.

It is a further object of the present invention to provide a system and a method of airlocks utilizable as entrances to buildings or parts of buildings that are under overpressure, having air purging devices.

According to the invention, there is provided an airlock system utilizable with a protected Toxic Free Area (TFA)

defined by an enclosure comprising spaced-apart first and second door arrangements, each door arrangement having an entrance and an exit and being divided by partitions into a plurality of sections; an airlock space coupled to, and bridging between, said first and second door arrangements; at least the exit of said second door arrangement being connectable to the protected TFA, while the first door having its entrance located outside said TFA; the arrangement being such that there is no direct airflow from the entrance of said first door arrangement to the exit of said second door arrangement.

The invention further provides a method for facilitating entrance and egress from a Toxic Free Area (TFA) defined by an enclosure, without the danger of contamination of the protected TFA, comprising providing an airlock system including spaced-apart first and second door arrangements each having an entrance and an exit and being divided by partitions into a plurality of sections, and an airlock space coupled to, and bridging between, said first and second door arrangements; operationally interconnecting said TFA with said system so that at least the exit of said second door arrangement being connectable to the protected TFA, while the first door arrangement having its entrance located outside said TFA and directing toxic-free airflow from the entrance of said second door arrangement to the exit of said first door arrangement.

The term "door arrangement" as referred to herein is intended to encompass not only the commonly used revolving or rotating door configuration, but also to apparatus likewise have hinged or sliding barriers for closing entrances or exits from defined spaces. Moreover, this term is meant to cover not only such barriers disposed and operating on a horizontal stationary or movable surface, but also to cover apparatus having doors which move on an incline, such as escalators and vertically moving elevators.

The main stream or an essential part of the air stream leaving the TFA has to be directed through the door arrangement, cleansing the door arrangement and its segments including those on the Contamination Control Area (CCA) with clean air and avoiding/reducing back contamination by the opening of the doors.

Highest efficiencies in the air locking process is achieved by having several rotating doors in sequence creating a cascade of cleansing and limiting the potential and volume of contamination. This is especially necessary since a great number of persons want to pass the airlocks at the same time and the purging time in one rotating door is not long enough to achieve sufficient decontamination. The required number of airlocks in series depends on the throughput of cleansed air and potential for contamination.

It is a special feature of the invention that will be applied in selectively required situations, that the door arrangement is equipped with a purified air purging device. The air purging device is a part of a closed loop system with air filters and blowers where the air flows with speeds higher than 0.3 m/s in a clear predefined direction. Preferable directions are from the ceiling of the door arrangement enclosure to the floor or radially from the center of the door arrangement to one or two sides of the lateral walls of the door arrangement.

Another special feature of the invention is that the purging spaces of the door arrangement is a cascaded air system, guiding the air through each purging space in a direction opposite the direction of contamination. That has not to be applied in all cases however when the calculation of the cleansing effect is done or when actual measurements of the cleansing effect are performed, it becomes obvious that such a configuration is highly recommendable in order to achieved dilution efficiencies of more than 99%. Such efficiencies are in most cases an inevitable must to achieve a level of air cleanliness that corresponds to that specified in standards requiring a 99.97% minimum efficiency done by the use of HEPA filters in the NBC-air cleaning system.

The typical direction of the airflow in one purging space of the door arrangement is down, in the next up, and so on. As an option, the airflow direction could be done as well in all purging chamber top down. The overall airflow direction is from the TFA to the CCA and from the CCA to the contaminated area.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic representation of a standard prior art airlock configuration used in shelters;

FIG. 2 is a top view of an airlock configuration with rotating doors as entrance and exit of the airlock to be used for applications with frequent entries and exits of persons, in accordance with the present invention;

FIG. 3 is a top cross-sectional view of a rotating door, according to the present invention;

FIG. 4 is a schematic illustration of the airlock of FIG. 3 arranged in series at an entrance to a building;

Figure 5A:
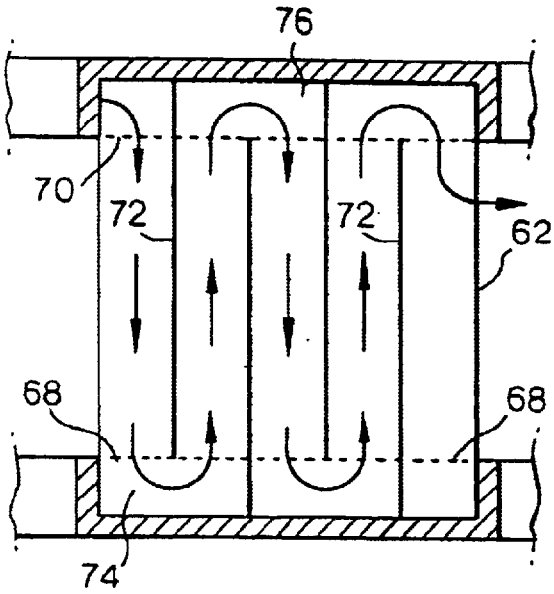
Figure 5B:
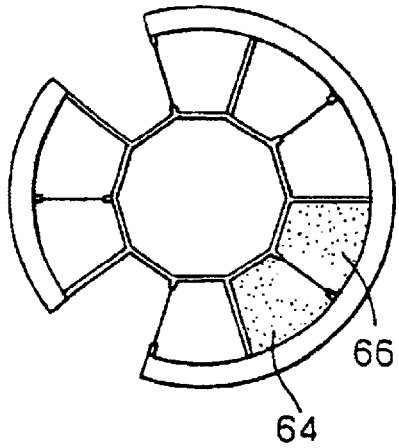
Figure 6A:
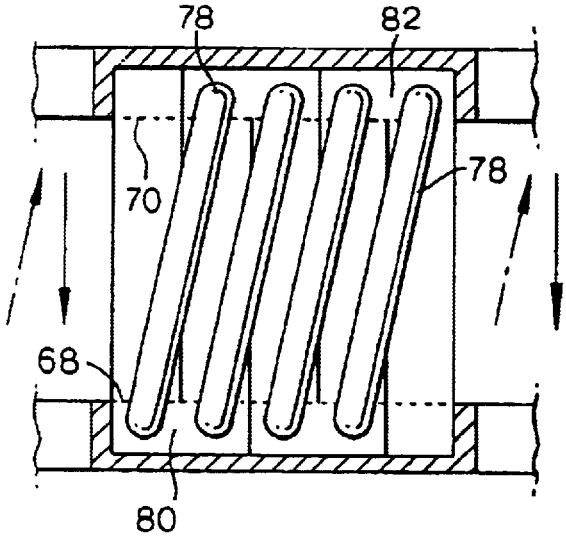
Figure 6B:
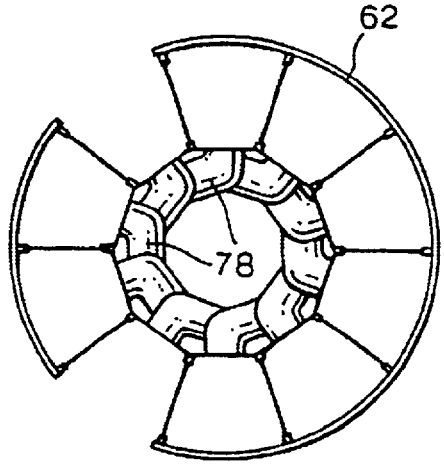
Figure 7:
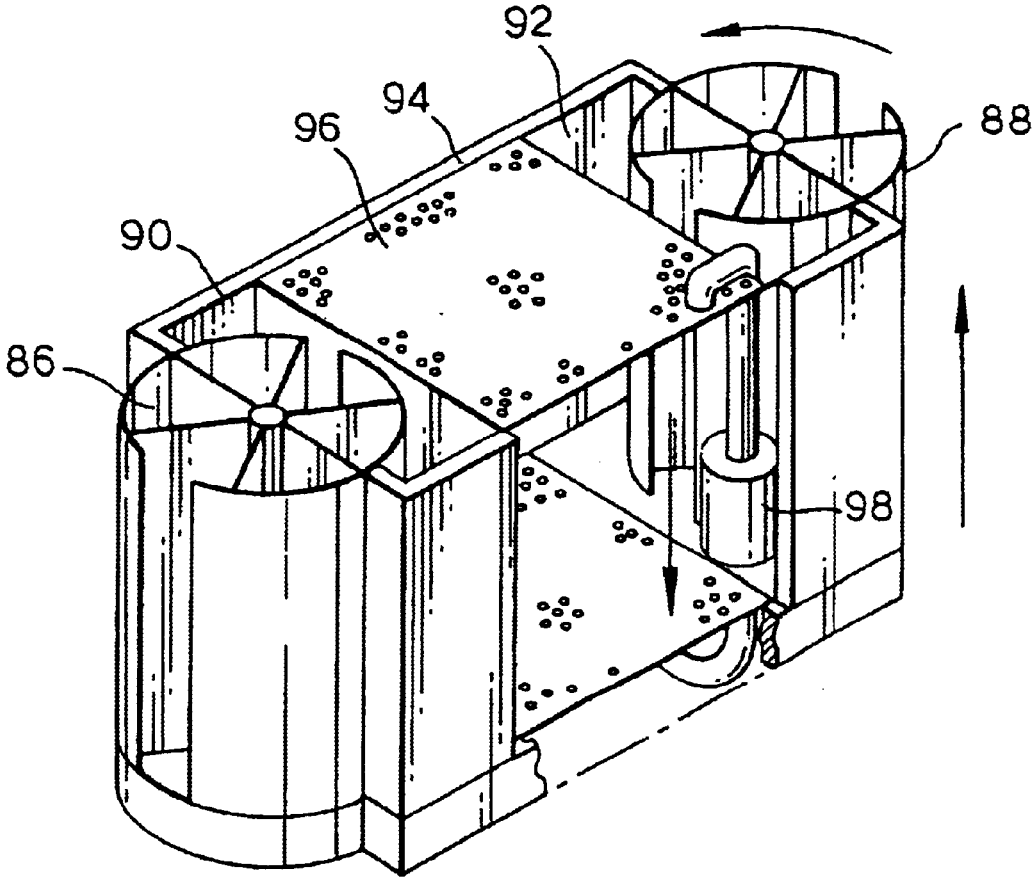

FIGS. 5*a* and 5*b* are cross-sectional and top views of an embodiment of a rotating door, incorporating purging sections;

FIGS. 6*a* and 6*b* are cross-sectional and top views of a further embodiment of a rotating door, incorporating purging sections, and FIG. 7 is an isometric view of an airlock with rotating doors and a purging section.

DETAILED DESCRIPTION OF PREFERRED EMBODIMENTS

For better understanding of the invention, the description and figures will refer to the most common and practical configuration of a door arrangement, in the form of rotating doors.

Figure 1:
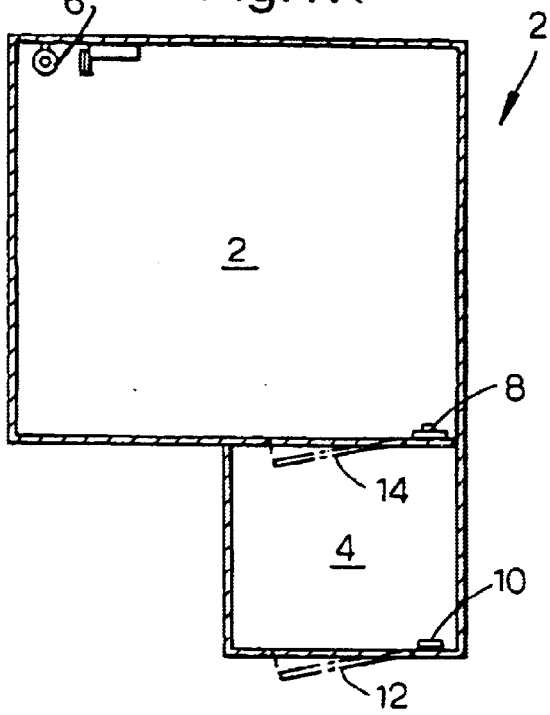
Fig.1. (PRIOR ART)

Referring now to the drawings, FIG. 1 shows a standard prior art airlock configuration comprising a protected space 2, an airlock space 4, an NBC filter 6, an exhaust valve 8 and an overpressure valve 10, used in shelters. Persons entering or leaving the protected space 2 of the shelter have to pass the airlock space 4 and keep one of both doors 12, 14 closed all the time during protection mode. Furthermore, they have to wait in the airlock space 4 for a certain period of time to be cleansed by the airflow passing from the protected space 2 to the airlock space 4 via the valves 8 and 10, until they can open the second door 14 to enter the protected space 2, in order to avoid bringing contaminated air with them into the shelter.

Figure 2:
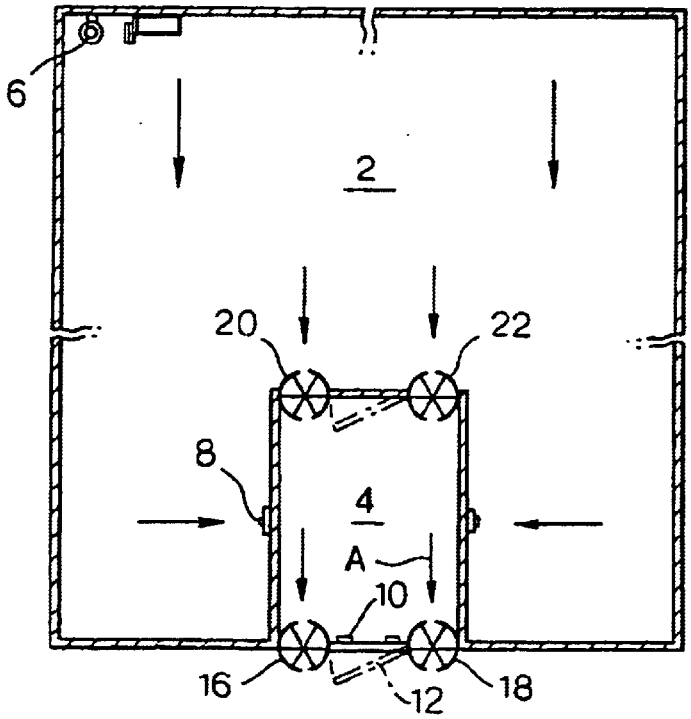

FIG. 2 schematically illustrates the principles of the present invention utilizing rotating doors 16, 18, 20, 22, instead of the typical locking doors 12, 14 of FIG. 1. As long as the rotating doors 16, 18, 20, 22 are not in use, the airflow overpressure in the TFA is regulated by valves 8, 10. Since the rotating doors are always leaking to a certain extent, a constant airflow in the direction as indicated by arrows A is provided, however, the airflow is minor to that flowing through the valves 8, 10. The doors 12, 14 for transporting equipment are typically closed all the time and used only for bulky equipment. In the architecture shown in this figure persons would have to wait during the purging time in order to become cleansed before being allowed to enter the protected space 2.

Figure 3:
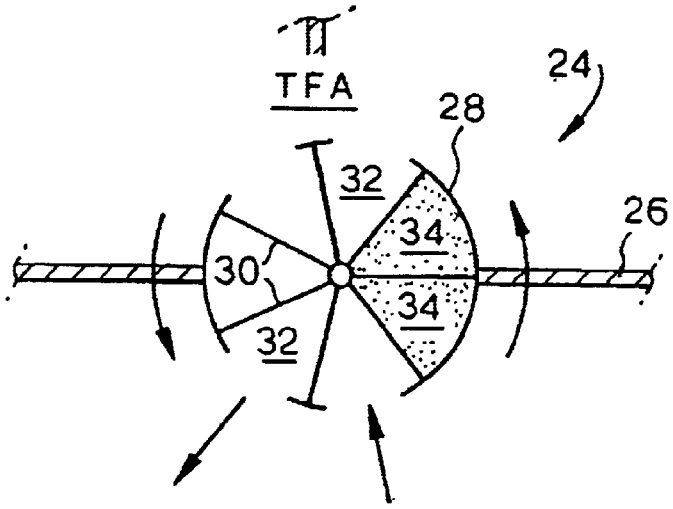

FIG. 3 illustrates an airlock unit 24 constituted by a combination of a rotating door having purging sections. Seen is a front wall 26 of a building or entrance to a TFA premises, in which the unit 24 is installed. The rotating door 28 divides the interior space by partitions 30 into compartments 32. The door 28 revolves counter-clockwise and sweeps through one or more purging sections 34, spreading across one or more compartments 32. The entrances into the unit 24 and exits therefrom are depicted by double-line arrows. The purging is effected by means of clean air, which can be channeled from the TFA protected space or provided by an independent source.

Figure 4:
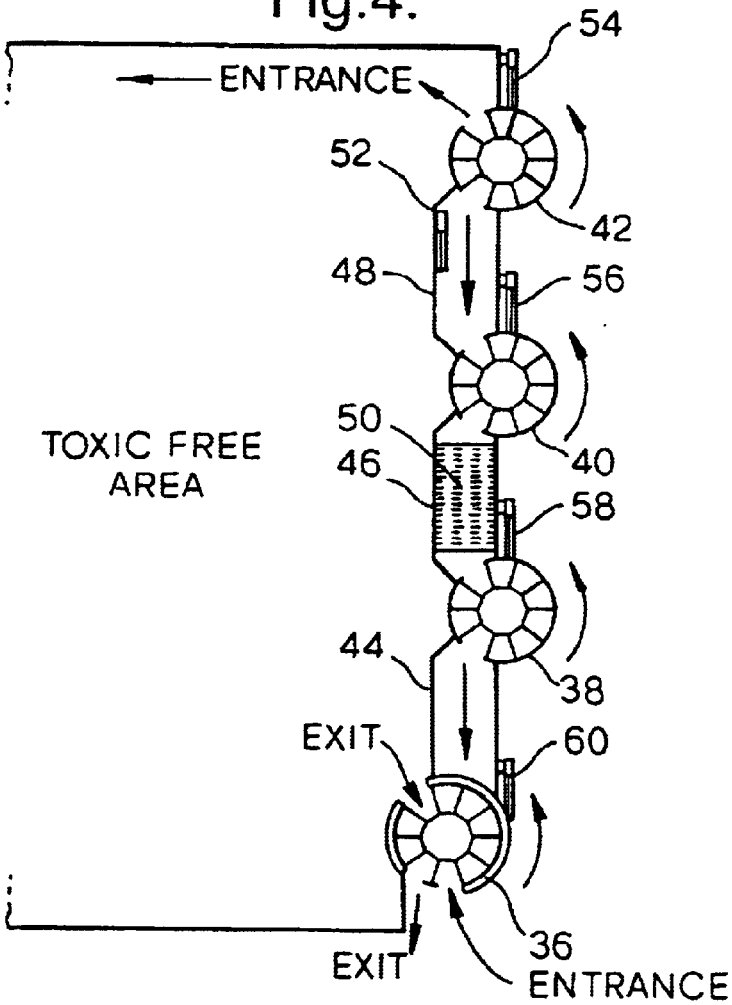

An embodiment according to the present invention shown in FIG. 4, utilizes several rotating doors 36, 38, 40, 42 spaced-apart from each other and operationally interconnected by three airlock spaces 44, 46, 48. The airlock spaces are coupled with the doors by any per se known means, e.g., elastic sealing elements such as brushes, rubber or plastic strips or sponges. The airlock 46 is optionally furnished with a purging arrangement 50. While FIG. 4 illustrates a linear series configuration of rotating doors and intermittent airlock spaces located at the entrance to a TFA, it should be realized that any other configuration could just as well be used to suit the architecture of a building or TFA. In addition, as seen, this arrangement includes a main blower 52 disposed in the airlock space 48. There may be provided further blowers in any one of the other airlock spaces. Also, advantageously there may be provided in one or several airlock rotating door combination, an additional blower 54, 56, 58, 60, sucking air from the space closer to the TFA into the rotating door. For example, blower 54 sucks air from the TFA into rotating door 42, while blower 60 sucks air from space 44 into the rotating door 36. Thus, there is formed an air flow emanating from the TFA and flowing in the counter direction to the direction of people entering the TFA from the outside.

Referring to FIGS. 5*a* and 5*b*, there is illustrated an embodiment of a rotating door 62, incorporating purging sections 64, 66. The rotating door 62 is built with a perforated air distribution floor 68 and a perforated air distribution ceiling 70 moving together with the entire rotating door structure, including the "wings" or partitions 72. In this case, a person does not walk through the door, but is transported by the door from the entrance to the exit. In each purging section, the air flows from and through the ceiling 70 towards the floor 68, passes a connection channel portion 74, underneath the floor 68, enters the next section from the floor, flows upwards towards the ceiling, enters same and passes therefrom through a channel portion 76 to the next section, as indicated by the arrows. Hence, the purging air meanders through the doors' sections.

FIGS. 6*a* and 6*b* illustrate the same type of rotating door, however, according to this embodiment, the airflow is directed from one section to the other via pipes 78, so that only the purging air is directed from the ceiling 70 towards the floor 68, while the returning air is channeled through the pipe 78 from the space 80 beneath the floor 68, towards the space 82 above the ceiling 70.

Turning now to FIG. 7, there are illustrated details of a complete airlock unit 84 having a purging device with rotating doors. Seen are two rotating doors 86, 88, having airlock spaces 90, 92, coupled to an intermediate airlock purging section 94, furnished with a purging device 96. In order to achieve an improved decontamination effect, the air in the airlock purging section 94 directed from the ceiling towards the floor, is cycled through an NBC filter/blower 98. Obviously, a separate blower can also be provided.

It has been found that for effective purging inside the revolving doors and/or airlock spaces, the air should be propelled at a rate higher than 0.3 m/s.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An airlock system utilizable with a protected Toxic Free Area (TFA) defined by an enclosure, said airlock system comprising:

spaced-apart first and second door arrangements, each door arrangement having an entrance and an exit and being divided by partitions into a plurality of compartments;

an airlock space coupled to, and bridging between, said first and second door arrangement;

at least the exit of said second door being connectable to the protected TFA, while the first door arrangement having an entrance located outside said TFA, and a first additional door arrangement and airlock space coupled to the entrance of said first door arrangement and a second additional airlock space and a door arrangement coupled to said second door arrangement, so as to form a closed system having a sequence of n door arrangements alternating with −1 airlock spaces, wherein n is an integer number;

the arrangement being such that there is no direct airflow from the entrance of said first door arrangement to the exit of said second door arrangement.

2. The system as claimed in claim 1, wherein there are provided means for creating overpressure in the TFA and air is directed from the TFA through the entrance of said second door arrangement towards the exit of said first door arrangement.

3. The system as claimed in claim 2, wherein said air is propelled by at least one of at least one blower and an overpressure regulating valve.

4. The system as claimed in claim 1, wherein said airlock space has side walls, a floor and a ceiling, further comprising a purging device directing air to at least one of along and across said space.

5. The system as claimed in claim 4, wherein said air is directed from the ceiling towards the floor via a filter/blower.

6. The system as claimed in claim 1, wherein at least one of said first and second door arrangement is a rotating door.

7. An airlock system utilizable with a protected Toxic Free Area (TFA) defined by an enclosure, said airlock system comprising:

spaced-apart first and second door arrangements, each door arrangement having an entrance and an exit and being divided by partitions into a plurality of compartments; an airlock space coupled to, and bridging between, said first and second door arrangement;

at least the exit of said second door being connectable to the protected TFA, while the first door arrangement having an entrance located outside said TFA;

wherein at least one compartment between two adjacent partitions in any one of said rotating doors is fitted with a purging device.

8. The system as claimed in claim 7, wherein said purging device comprises a perforated ceiling, a rotatable perforated floor and channel portions alternatingly interconnecting spaces above the ceiling and below the floor bridging two adjacent compartments, so as to facilitate purging air to meander from the ceiling of one compartment downwards towards the floor and then upwards towards the ceiling of an adjacent compartment.

9. The system as claimed in claim 7, further comprising pipes interconnecting channel portions above the ceiling and below the floor of adjacent sections, so as to direct air from below the floor portion to above a ceiling portion of an adjacent compartment.

10. The system as claimed in claim 7, further comprising a first additional door arrangement and airlock space coupled to the entrance of said first door arrangement and a second additional airlock space and a door arrangement coupled to said second door arrangement, so as to form a closed system having a sequence of n door arrangements alternating with −1 airlock spaces, wherein n is an integer number.

11. A method for facilitating entrance and egress from a Toxic Free Area (TFA) defined by an enclosure, without the danger of contamination of the protected TFA, said method comprising:

providing at least one airlock system including spaced-apart first and second door arrangements each having an entrance and an exit and being divided by partitions into a plurality of compartments, and an airlock space coupled to, and bridging between, said first and second door arrangements, and coupling a first additional door arrangement and airlock space to the entrance of said first door arrangement and coupling a second additional airlock space and a door arrangement to said second door arrangement, so as to form a closed system having a sequence of n door arrangements alternating with −1 airlock spaces, wherein n is an integer number;

operationally interconnecting said TFA with said system so that at least the exit of said second door arrangement being connectable to the protected TFA, while the first door arrangement having its entrance located outside said TFA, and directing toxic-free airflow from the entrance of said second door arrangement to the exit of said first door arrangement.

12. The method as claimed in claim 11, wherein said toxic-free air is directed from said TFA.

13. The method as claimed in claim 11, wherein said air is propelled at a rate higher than 0.3 m/s.

14. The method as claimed in claim 11, wherein there is provided at least one purging device associated with at least one of a door arrangement and an airlock space, and during operation, directing air to at least one of through and across at least one of said door arrangement and space for purging persons passing therethrough.

15. The method as claimed in claim 14, wherein purging air flowing through said door arrangement is propelled from one compartment to another via perforated ceilings and floors having channel portions interconnecting two adjacent compartments.

16. The method as claim in claim 14, wherein purging air flowing through said door arrangement is propelled from one compartment to another via pipes extending from a channel under a perforated floor area in one compartment, to a channel above the ceiling area of an adjacent compartment, wherein said channels bridge two adjacent sections compartments.

17. An airlock system utilizable with a protected Toxic Free Area (TFA) defined by an enclosure comprising:

spaced-apart first and second door arrangements, each door arrangement having an entrance and an exit and being divided by partitions into a plurality of compartments;

said compartments defining, in cross-section, a truncated segment of a circle;

an airlock space coupled to, and bridging between, said first and second door arrangement;

at least the exit of said second door being connectable to the protected TFA, while the first door arrangement having its entrance located outside said TFA;

the arrangement being such that there is no direct airflow from the entrance of said first door arrangement to the exit of said second door arrangement.

18. An airlock system utilizable with a protected Toxic Free Area (TFA) defined by an enclosure comprising:

spaced-apart first and second door arrangements, each door arrangement having an entrance and an exit and being divided by more than four partitions into a plurality of compartments;

an airlock space coupled to, and bridging between, said first and second door arrangement;

at least the exit of said second door being connectable to the protected TFA, while the first door arrangement having its entrance located outside said TFA;

the arrangement being such that there is no direct airflow from the entrance of said first door arrangement to the exit of said second door arrangement.

19. An airlock system utilizable with a protected Toxic Free Area (TFA) defined by an enclosure, said airlock system comprising:

spaced-apart first and second door arrangements, each door arrangement having an entrance and an exit and being divided by partitions into a plurality of sections;

an airlock space coupled to, and bridging between, said first and second door arrangement;

at least the exit of said second door being connectable to the protected TFA, while the first door arrangement having an entrance located outside said TFA;

the arrangement being such that there is no direct airflow from the entrance of said first door arrangement to the exit of said second door arrangement;

at least one of said first and second door arrangement being a rotating door; and at least one section between two adjacent partitions in any one of said rotating doors being fitted with a purging device.

20. A method for facilitating entrance and egress from a Toxic Free Area (TFA) defined by an enclosure, without the danger of contamination of the protected TFA, said method comprising:

providing at least one airlock system including spaced-apart first and second door arrangements each having an entrance and an exit and being divided by partitions into a plurality of sections, and an airlock space coupled to, and bridging between, said first and second door arrangements;

operationally interconnecting said TFA with said system so that at least the exit of said second door arrangement being connectable to the protected TFA, while the first door arrangement having its entrance located outside said TFA;

directing toxic-free airflow from the entrance of said second door arrangement to the exit of said first door arrangement;

providing at least one purging device associated with at least one of a door arrangement and an airlock space, and during operation, directing air to at least one of through and across at least one of said door arrangement and space for purging persons passing therethrough; and propelling purging air flowing through said door arrangement from one section to another via perforated ceilings and floors having channel portions interconnecting two adjacent sections.

21. A method for facilitating entrance and egress from a Toxic Free Area (TFA) defined by an enclosure, without the danger of contamination of the protected TFA, said method comprising:

providing at least one airlock system including spaced-apart first and second door arrangements each having an entrance and an exit and being divided by partitions into a plurality of sections, and an airlock space coupled to, and bridging between, said first and second door arrangements;

operationally interconnecting said TFA with said system so that at least the exit of said second door arrangement being connectable to the protected TFA, while the first door arrangement having its entrance located outside said TFA;

directing toxic-free airflow from the entrance of said second door arrangement to the exit of said first door arrangement;

providing at least one purging device associated with at least one of a door arrangement and an airlock space, and during operation, directing air to at least one of through and across at least one of said door arrangement and space for purging persons passing therethrough; and propelling purging air flowing through said door arrangement from one section to another via pipes extending from a channel under a perforated floor area in one section, to a channel above the ceiling area of an adjacent section, wherein said channels bridge two adjacent sections.

* * * * *